US010480149B1

(12) United States Patent
Abbas et al.

(10) Patent No.: US 10,480,149 B1
(45) Date of Patent: Nov. 19, 2019

(54) SYSTEM FOR CONSTRUCTING A RETAINING WALL

(71) Applicant: KING SAUD UNIVERSITY, Riyadh (SA)

(72) Inventors: Husain Abbas, Riyadh (SA); Abdullah H. Alsabhan, Riyadh (SA); Yousef A. Al-Salloum, Riyadh (SA); Abobaker S. Binyahya, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/256,154

(22) Filed: Jan. 24, 2019

(51) Int. Cl.
*E02D 29/02* (2006.01)

(52) U.S. Cl.
CPC ..... *E02D 29/0241* (2013.01); *E02D 29/025* (2013.01)

(58) Field of Classification Search
CPC ..... E02D 29/025; E02D 29/0241; E02D 29/0225; E02D 29/0233; E04B 2002/0245; E04B 2002/0247
See application file for complete search history.

(56) References Cited

U.S. PATENT DOCUMENTS

| | | | | |
|---|---|---|---|---|
| 4,728,227 | A | 3/1988 | Wilson et al. | |
| 4,998,397 | A | 3/1991 | Orton | |
| 5,975,809 | A | 11/1999 | Taylor et al. | |
| D624,204 | S | 9/2010 | Bott | |
| 7,828,498 | B2 | 11/2010 | Sorheirn et al. | |
| 2003/0070385 | A1 | 4/2003 | Bott | |
| 2003/0213203 | A1* | 11/2003 | Bott | E02D 29/0241 52/603 |
| 2005/0129468 | A1 | 6/2005 | Knudson et al. | |
| 2005/0254906 | A1 | 11/2005 | Dolan et al. | |
| 2006/0239783 | A1 | 10/2006 | Kallen | |
| 2011/0243669 | A1* | 10/2011 | Friederichs | E02D 29/025 405/284 |
| 2014/0314501 | A1 | 10/2014 | Usagani | |
| 2016/0177533 | A1 | 6/2016 | May et al. | |

FOREIGN PATENT DOCUMENTS

JP 5681725 A 7/1981

OTHER PUBLICATIONS

"Retaining Wall Reinforcement: Other Options", printed from https://www.allanblock.co.uk/reinforcement-options.aspx on Dec. 10, 2018 (6 pages).

* cited by examiner

*Primary Examiner* — Carib A Oquendo
(74) *Attorney, Agent, or Firm* — Richard C. Litman; Nath, Goldberg & Meyer

(57) ABSTRACT

The system for constructing a retaining wall can be used to construct a segmental retaining wall for retaining earth, on either side, at two different levels. The system includes a plurality of blocks. Each block has laterally opposed first and second end portions, a central portion and a neck portion. The central portion is positioned between the first end portion and the neck portion, and the neck portion is positioned between the second end portion and the central portion. The central portion has a longitudinal length less than a longitudinal length of the first end portion, the second end portion has a longitudinal length less than the longitudinal length of the central portion, and the neck portion has a longitudinal length less than the longitudinal length of the second end portion. A plurality of pegs can vertically interlock adjacent blocks. Tie connectors can connect the blocks to an external pipe.

4 Claims, 13 Drawing Sheets

SYSTEM FOR CONSTRUCTING A RETAINING WALL

BACKGROUND

1. Field

The disclosure of the present patent application relates to construction of retaining walls, and particularly to a set of interlocking blocks for constructing a segmental retaining wall for retaining earth at two different levels.

2. Description of the Related Art

Retaining walls are typically used for providing lateral support for filled earth. Retaining walls are often used for retaining earth piled on either side of the wall at different heights. Such earth retaining systems are typically categorized as being either externally stabilized or internally stabilized (or a combination of the two). Externally stabilized systems include gravity, cantilevers, counterforts, sheet-pile walls, etc. Internally stabilized systems, on the other hand, employ internal stabilization in order to reduce the lateral pressure (caused by the piled earth) on the walls. The reduction in the earth pressure on these walls makes it possible to use dry-stacked pre-cast blocks (with aesthetic faces) in their construction, thereby reducing their cost and speeding up their construction.

The internal stabilization in segmental walls (or block walls) is achieved through the use of soil nailing, geo-textile/geo-grid, reinforcement of the soil, etc. For the composite action of reinforced soil and the facing blocks, the geo-reinforcement is connected to the facing blocks, either through a frictional connection by embedding the geogrid ends in the block courses (in the case of flexible geogrid reinforcement), or by using mechanical connectors (in the case of relatively rigid geogrid reinforcement). Although numerous conventional blocks and connectors are known, such conventional systems tend to be prone to failure or deformation. Thus, a set of interlocking blocks for constructing a retaining wall solving the aforementioned problems is desired.

SUMMARY

The system for constructing a retaining wall includes a set of interlocking blocks. Each block has laterally opposed first and second end portions, a central portion and a neck portion. The central portion is positioned between the first end portion and the neck portion, and the neck portion is positioned between the second end portion and the central portion. The central portion has a longitudinal length less than a longitudinal length of the first end portion, the second end portion has a longitudinal length less than the longitudinal length of the central portion, and the neck portion has a longitudinal length less than the longitudinal length of the second end portion.

A vertically extending passage is formed through the central and neck portions; i.e., a single vertically extending passage is formed through each block, and the vertically extending passage extends laterally from the central portion into the neck portion. In a non-limiting example, the vertically extending passage has a substantially trapezoidal cross-sectional contour.

Each block has vertically opposed upper and lower surfaces, with a plurality of upper recesses being formed in the upper surface, and a plurality of lower recesses being formed in the lower surface. Each block also has a pair of longitudinally opposed, vertically extending recesses, which are defined between the central portion, neck portion and second end portion.

A plurality of pegs are provided for vertically interlocking adjacent blocks. Each peg has opposed first and second ends, with the first end being adapted to be received within one of the plurality of upper recesses of each block, and with the second end being adapted to be received within one of the plurality of lower recesses of each block. As a non-limiting example, each upper recess may have a substantially square cross-sectional contour, with the first end of each peg having a corresponding mating substantially square cross-sectional contour. As a further non-limiting example, each lower recess may have a substantially circular cross-sectional contour, with the second end of each peg having a corresponding mating substantially circular cross-sectional contour.

A plurality of tie connectors are also provided for connecting the blocks to an external pipe. Each tie connector has a main body portion, having laterally opposed first and second ends, and a rod. The rod has laterally opposed first and second ends, with the second end thereof being secured to the first end of the main body portion. The first end of the rod is adapted for securement to the external pipe. The rod extends laterally from the main body portion.

Each tie connector also includes a pair of longitudinally opposed, substantially L-shaped legs secured to the second end of the main body portion and extending laterally therefrom. The pair of longitudinally opposed, substantially L-shaped legs are adapted to slidably engage the pair of longitudinally opposed, vertically extending recesses of each block. In order to allow each tie connector to vertically settle as earth is filled around the blocks forming the retaining wall, each vertically extending recess may have an upper portion, a lower portion and a central portion, with the central portion having a lateral length less than a lateral length of the upper portion, and the lower portion having a lateral length less than the lateral length of the central portion.

A retaining wall is constructed using the blocks following the below method:

a) placing a levelled concrete footing pad on a region of ground;

b) positioning a course of blocks on the levelled concrete footing pad, the course of blocks being aligned, each with respect to the other;

c) placing drainage fill within and behind the course of blocks;

d) backfilling behind a drainage zone with backfill;

e) spreading a geogrid on the backfill, where the geogrid includes an overhanging region;

f) positioning a row of gunny bags on the geogrid;

g) positioning a pipe under an edge of the row of gunny bags and connecting the course of blocks to the pipe;

h) wrapping the geogrid around the row of gunny bags and pulling a tail end of the geogrid;

i) filling a gap between the row of gunny bags and the course of blocks, and filling the vertically-extending passage of each block;

j) turning the geogrid towards the course of blocks and backfilling soil on an opposite side of the row of gunny bags;

k) positioning a subsequent course of blocks with a longitudinal offset with respect to the course of blocks;

l) repeating steps i) to k) a desired number of times to achieve a retaining wall having a desired number of longitudinally-offset courses of the blocks;

m) pressing an end of the geogrid under an adjoining row of the gunny bags; and n) repeating steps e) to m) a desired number of times to achieve the retaining wall having a desired height.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
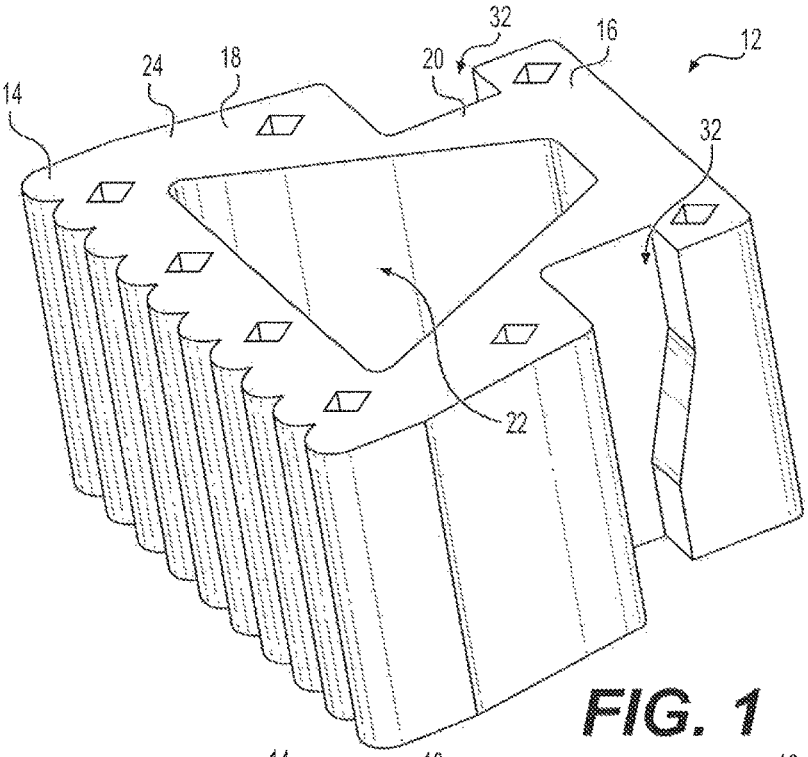
FIG. 1 is a top elevational view of a block of the system for constructing a retaining wall.
Figure 2:
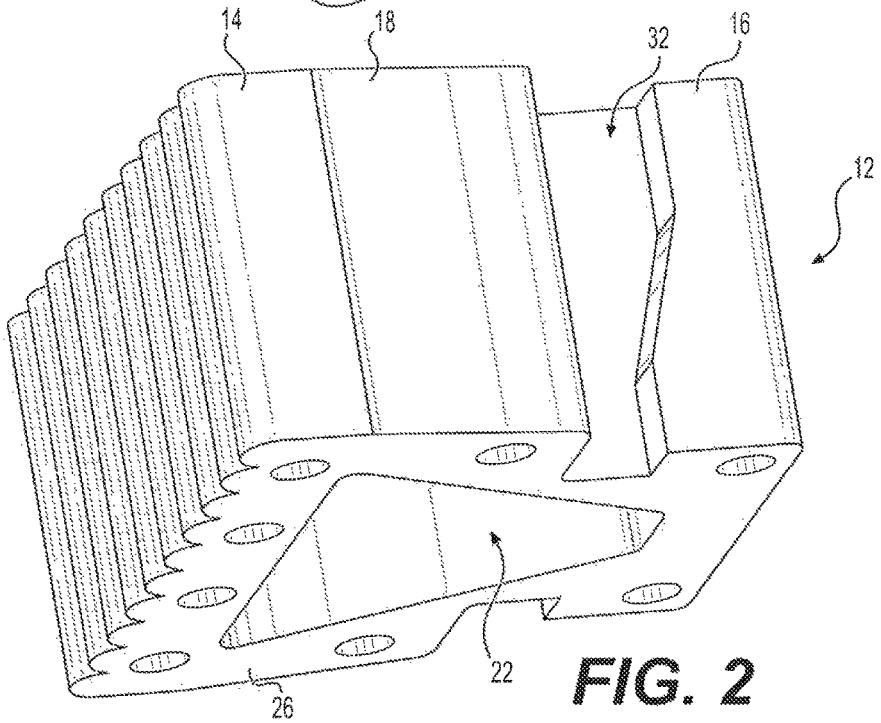
FIG. 2 is a bottom elevational view of the block of FIG. 1.

As shown in FIGS. 1-5B, a system for constructing a retaining wall 10 (such as the wall shown in FIG. 9) can include set of interlocking blocks 12. The retaining wall system 10 can include a plurality of pegs 34 for vertically interlocking the blocks 12. The system can be used to construct a segmental retaining wall for retaining earth, on either side, at two different levels. As shown in FIGS. 1, 2, 3A and 3B, each block 12 has laterally opposed first and second end portions 14, 16, respectively, a central portion 18 and a neck portion 20. With reference to FIG. 3A, the lateral direction is defined by the X-axis and the longitudinal direction is defined by the Y-axis. With reference to FIGS. 1 and 2, each block 12 also has a vertical height, with the vertical being defined orthogonal to the lateral-longitudinal plane (i.e., the X-Y plane).

Figure 3A:
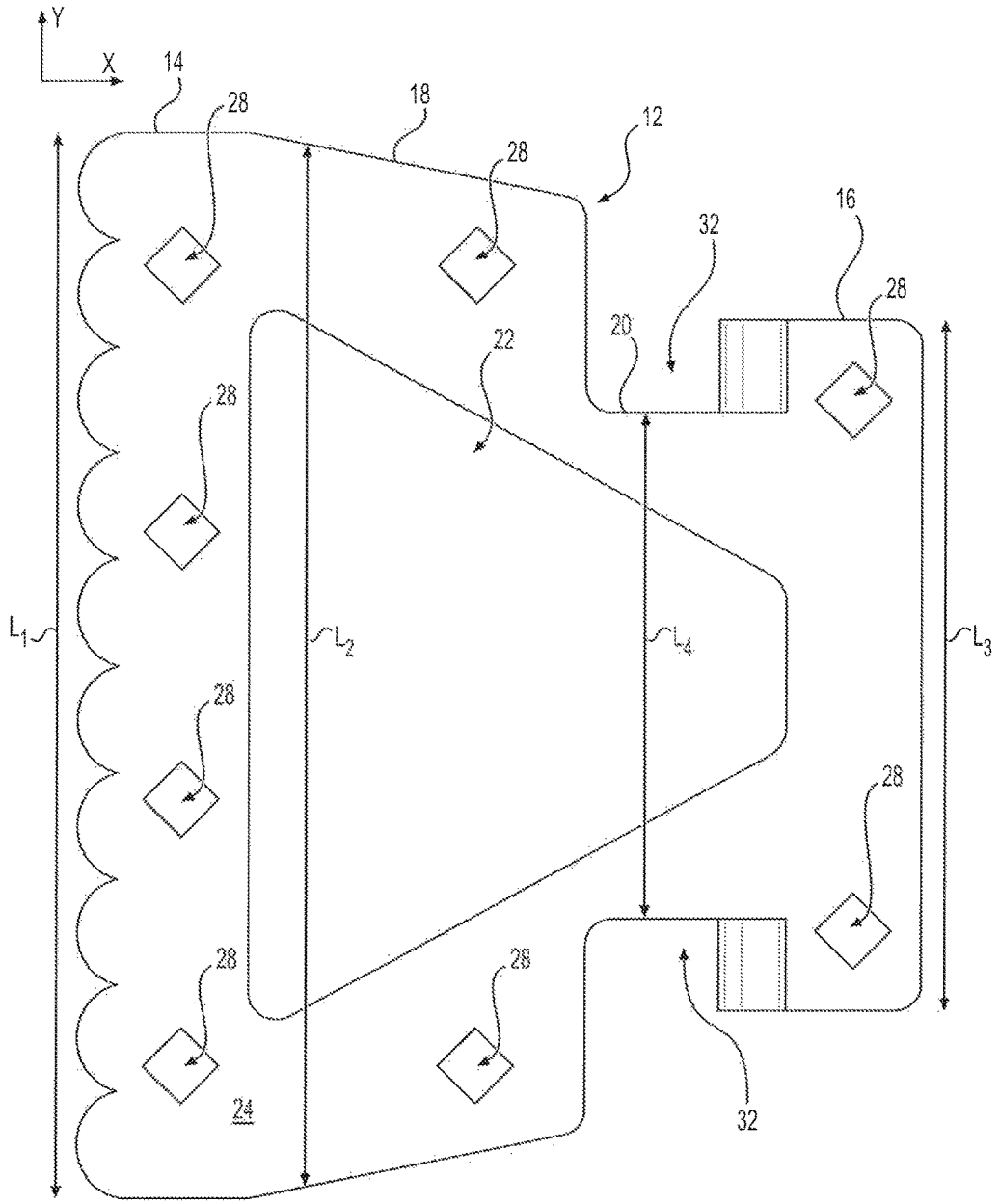
FIG. 3A is a top view of the block of FIG. 1.
Figure 3B:
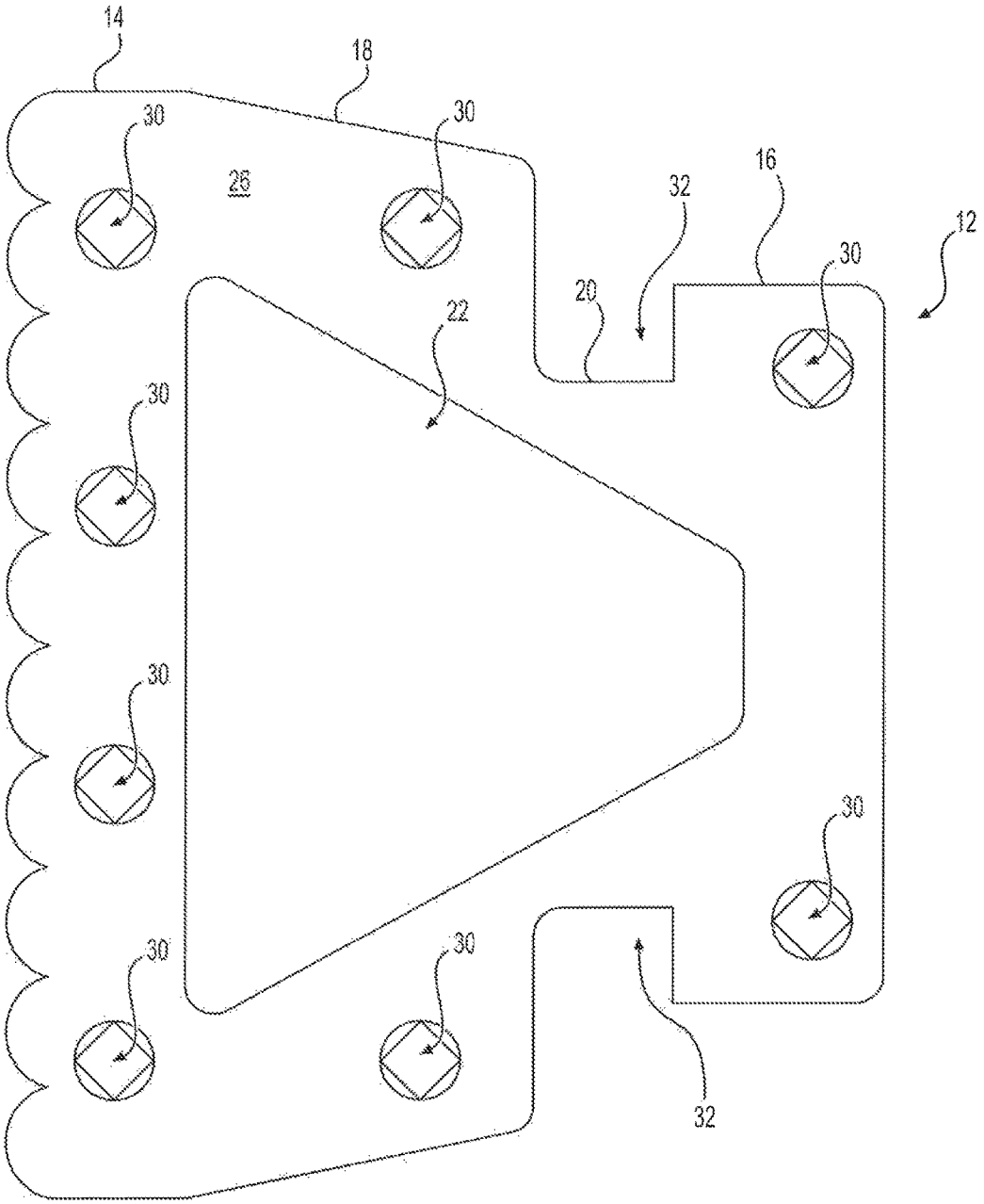
FIG. 3B is a bottom view of the block of FIG. 1.

The central portion 18 is positioned between the first end portion 14 and the neck portion 20, and the neck portion 20 is positioned between the second end portion 16 and the central portion 18. The central portion 18 has a longitudinal length $L_2$ which is less than a longitudinal length $L_1$ of the first end portion 14, the second end portion 16 has a longitudinal length $L_3$ which is less than the longitudinal length $L_2$ of the central portion 18, and the neck portion 20 has a longitudinal length $L_4$ which is less than the longitudinal length $L_3$ of the second end portion 16. As shown in FIGS. 3A and 3B, the central portion 18 may have a tapering longitudinal length, such that length $L_2$ decreases at a linear rate from its maximum length of $L_1$.

As a non-limiting example, length $L_1$ may be 400 mm, length $L_2$ may have a maximum length of 400 mm, length $L_3$ may be 260 mm, and length $L_4$ may be 190 mm. The overall lateral length may be 300 mm, with the lateral thickness of first end portion 14 being 50 mm, the lateral thickness of second end portion being 50 mm, the lateral thickness of neck portion 20 varying between 25 mm and 65 mm, and the lateral thickness of central portion 18 varying between 65 mm and 105 mm. The vertical height of block 12 may be 200 mm. When constructed from normal weight concrete, the mass of such an exemplary block 12 would be approximately 30.9 kg.

A vertically extending passage 22 extends through the central and neck portions 18, 20. The vertically extending passage 22 is formed through each block 12, and the vertically extending passage 22 extends laterally from the central portion 18 into the neck portion 20. In the non-limiting example best shown in FIGS. 3A and 3B, the vertically extending passage 22 has a substantially trapezoidal cross-sectional contour with rounded corners. Corresponding to the exemplary dimensions given above, the lateral length of vertically extending passage 22 may be 200 mm, and the longitudinal length thereof varying between 60 mm and 270 mm.

Each block 12 has vertically opposed upper and lower surfaces 24, 26, respectively. As shown in FIGS. 1, 2, 3A and 3B, a plurality of upper recesses 28 are formed in the upper surface 24, and a plurality of lower recesses 30 are formed in the lower surface 26. As shown, each block 12 also has a pair of longitudinally opposed, vertically extending recesses 32, which are defined between the central portion 18, neck portion 20 and second end portion 16. Further, as shown in FIGS. 1 and 2, although the front face of block 12 is shown as being corrugated, it should be understood that this corrugation is purely ornamental in appearance, and the front face may have any desired ornamental or aesthetic contouring. Corresponding to the exemplary dimensions given above, each upper recess 28 may have a vertical depth of 45 mm, and each lower recess 30 may have a vertical depth of 25 mm.

Figure 4:
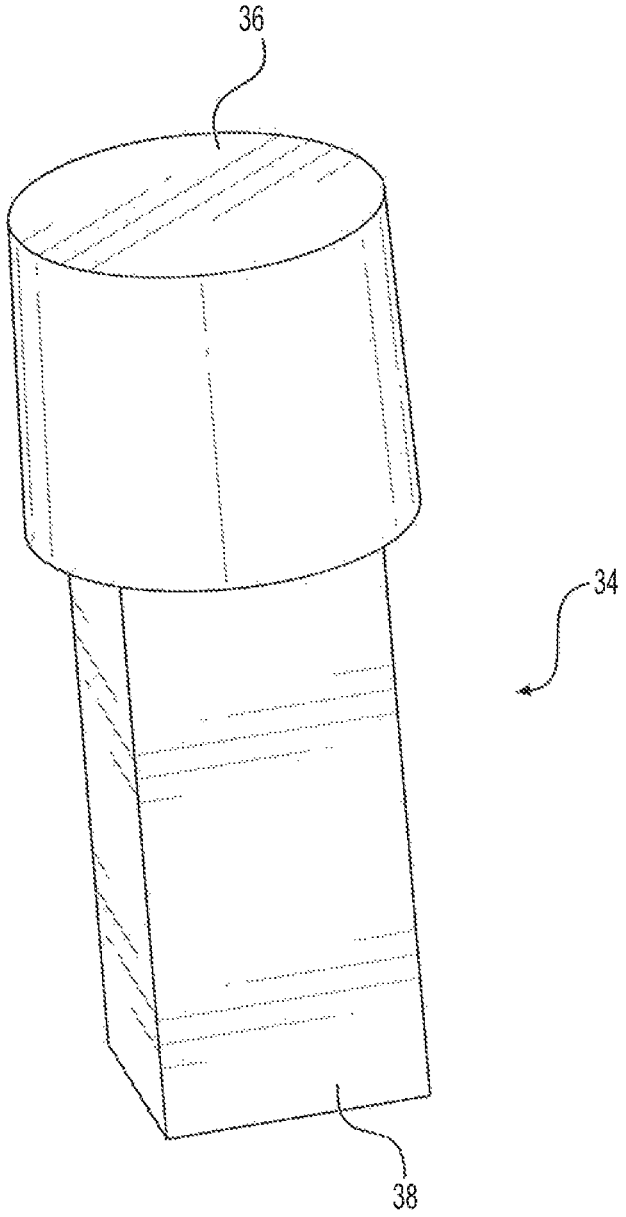
FIG. 4 is a perspective view of a peg of the system for constructing a retaining wall.
Figure 5A:
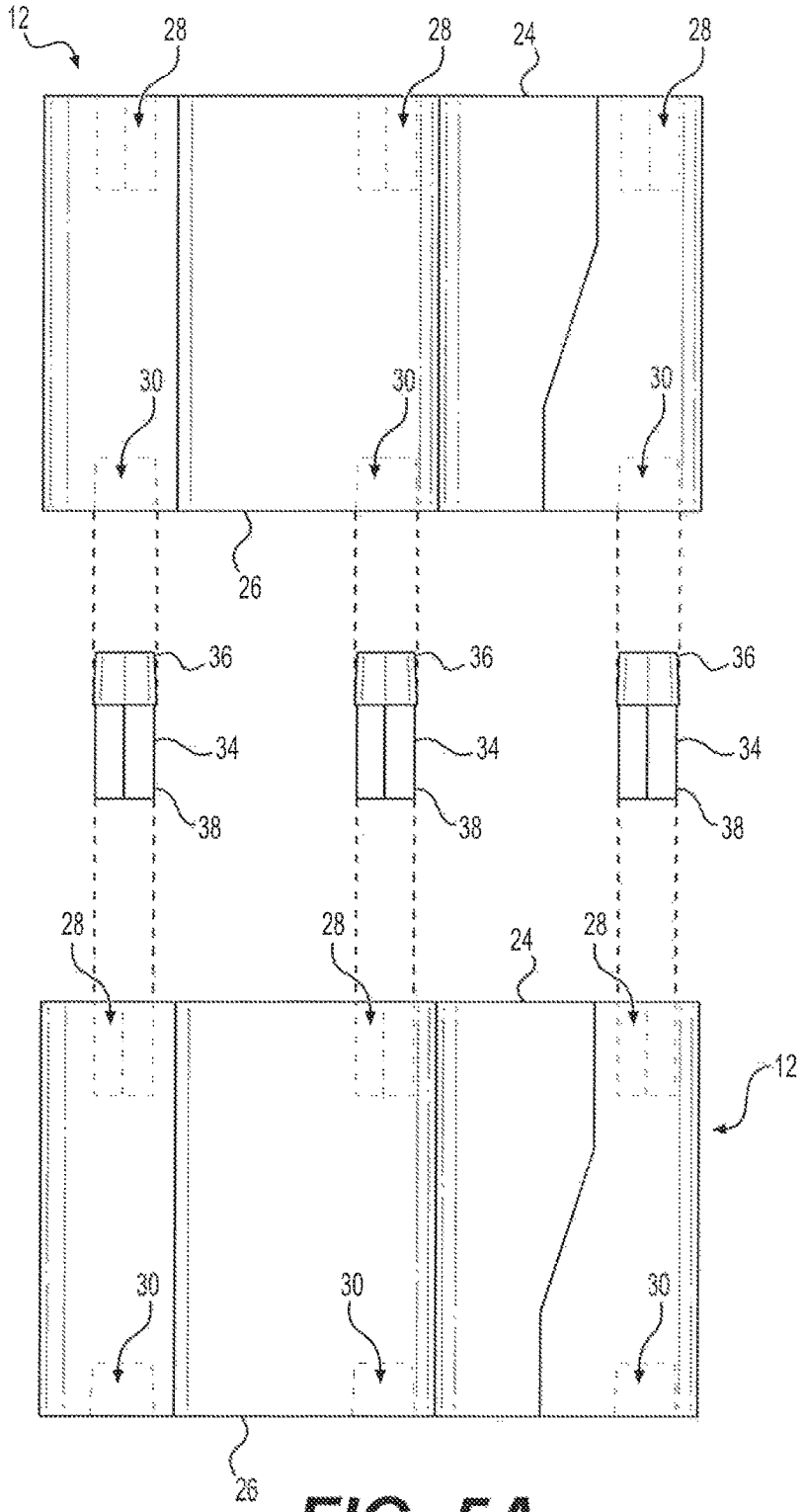
FIG. 5A is a side view showing two of the blocks being connected by a plurality of the pegs of FIG. 4.

As shown in FIGS. 4 and 5A, the plurality of pegs 34 are provided for vertically interlocking adjacent blocks 12. A first end 38 of each peg 34 is adapted to be received within one of the plurality of upper recesses 28 of a block 12. Similarly, a second end 36 of each peg 34 is adapted to be received within one of the plurality of lower recesses 30 of an adjacent block 12. As a non-limiting example, each upper recess 28 may have a substantially square cross-sectional contour, with the first end 38 of each peg 34 having a corresponding mating substantially square cross-sectional contour. As a further non-limiting example, each lower recess 30 may have a substantially circular cross-sectional contour, with the second end 36 of each peg 34 having a corresponding mating substantially circular cross-sectional contour.

Figure 5B:
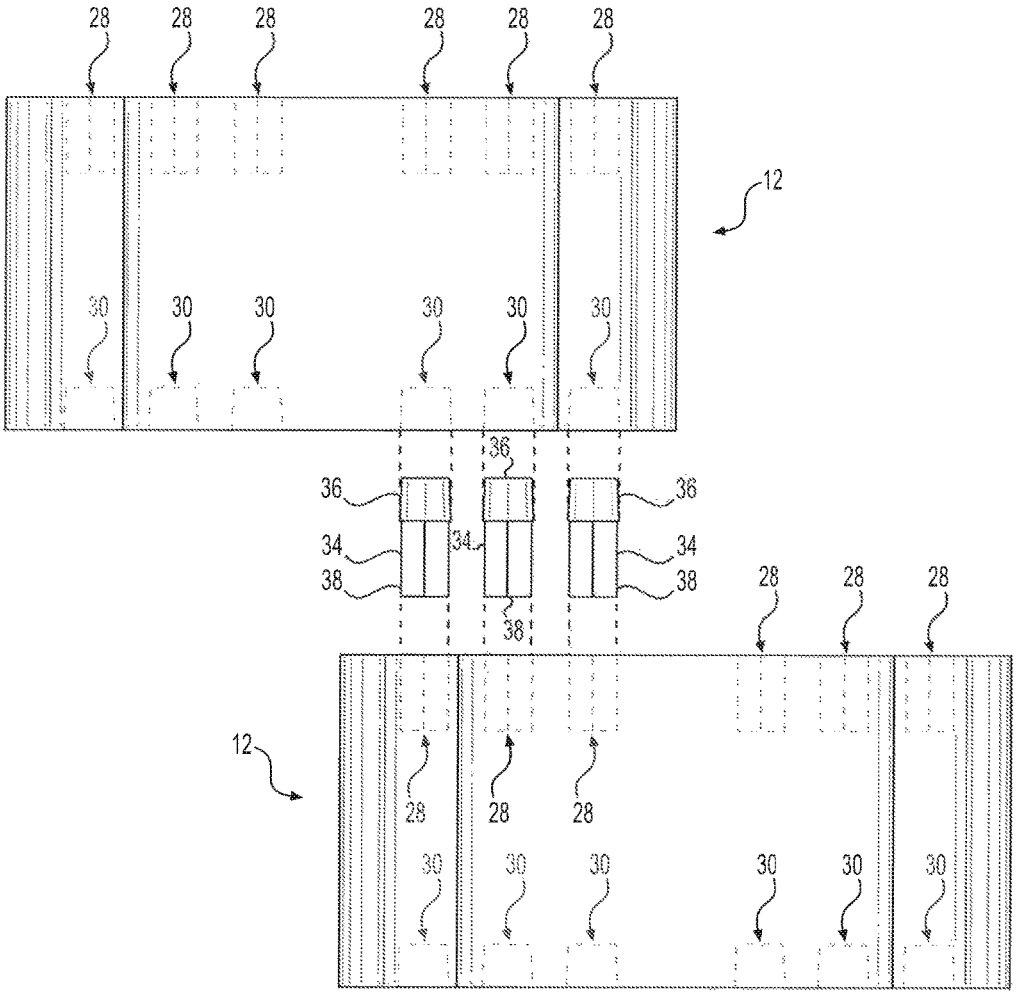
FIG. 5B is a rear view showing two of the blocks being connected by a plurality of the pegs of FIG. 4, where the two blocks are being connected in an offset position.

In FIG. 5A, the two blocks 12 are shown laterally and longitudinally aligned with one another. It should, however, be understood that any upper recess 28 may be joined to any lower recess 30 by a corresponding peg 34. FIG. 5B illustrates an example in which the two blocks 12 are staggered longitudinally. It should be noted that FIG. 5A illustrates a side view of the two blocks 12, and FIG. 5B illustrates a rear view of the two staggered blocks 12. However, returning to FIGS. 3A and 3B, a plurality of upper recesses 28 are provided on upper surface 24 and, similarly, a plurality of lower recesses 30 are provided on lower surface 26. Although eight such recesses are shown on each of the upper and lower surfaces 24, 26, it should be understood that any desired number of recesses may be used. A wide array of connecting combinations between adjacent blocks 12 are possible. The locations of recesses 28, 30, as shown, permit offsets of adjacent blocks 12 of zero (i.e., no offset or staggering), one-quarter, and half-block lengths. However, as noted above, the offset may be varied, either by varying the positioning of recesses 28, 30, or by positioning blocks 12 without the use of pegs 34. For walls of smaller height, the pegs 34 may either be eliminated or reduced in number. Corresponding to the exemplary dimensions given above, each peg 34 may have a height of 70 mm. Lower end 38 of peg 34 (and each upper recess 28) may have a side length of the square cross-section of 20 mm. Upper end 36 of peg 34 (and each lower recess 30) may have a diameter ranging between 27.5 mm and 30 mm (as shown, each upper end 36 and each lower recess 30 may be contoured as a frustum of a cone).

In addition to the usage of pegs 34, the filling of vertically extending passage 22 of block 12 provides additional aggregate interlock. This interlock assists in maintaining blocks 12, stacked in the same course, as well as blocks of consecutive courses, firmly in position. The size of vertically extending passage 22 is large enough to provide the aggregate interlock between the two consecutive courses for blocks 12 laid in offset positions.

Figure 6:
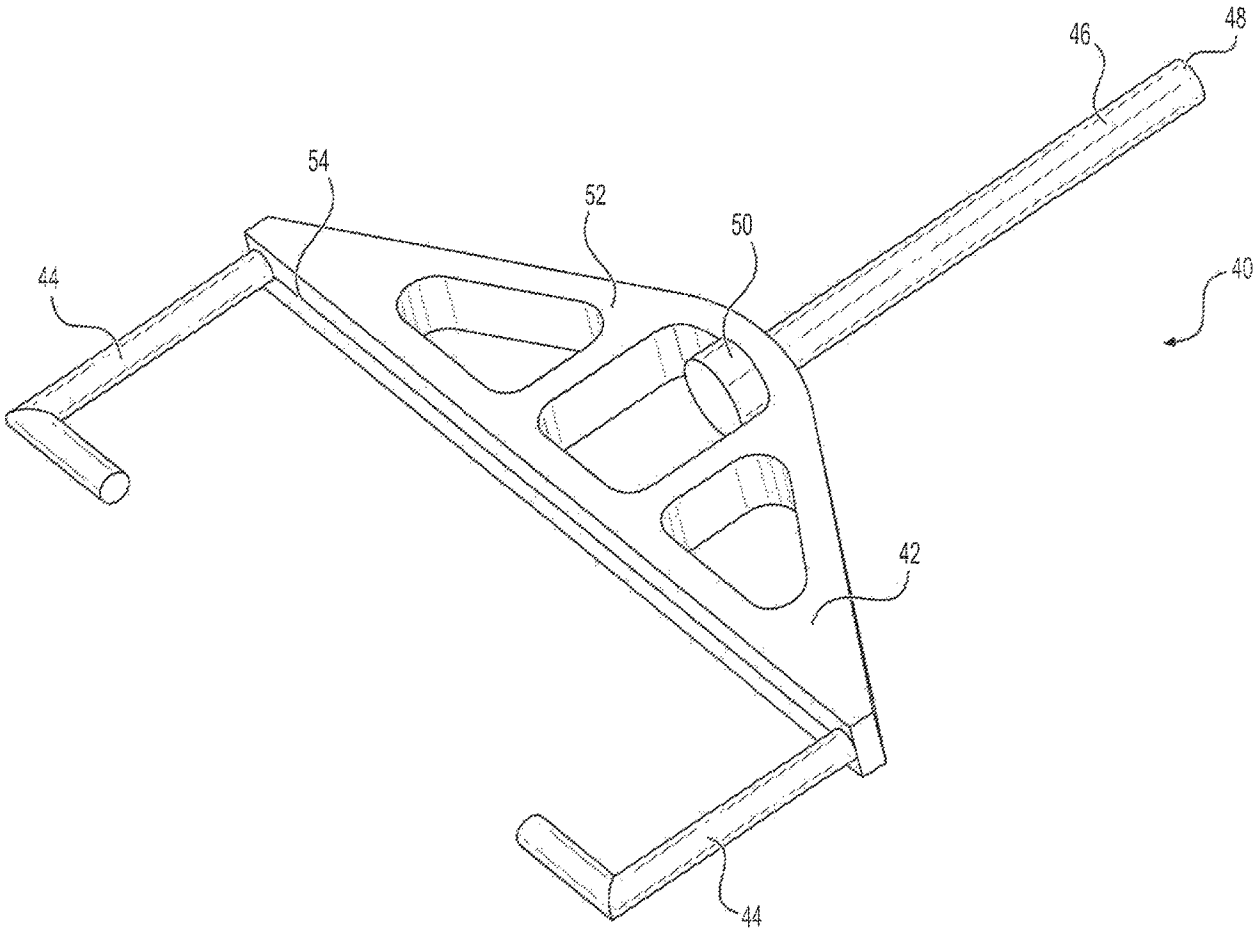
FIG. 6 is a perspective view of a tie connector of the system for constructing a retaining wall.
Figure 7:
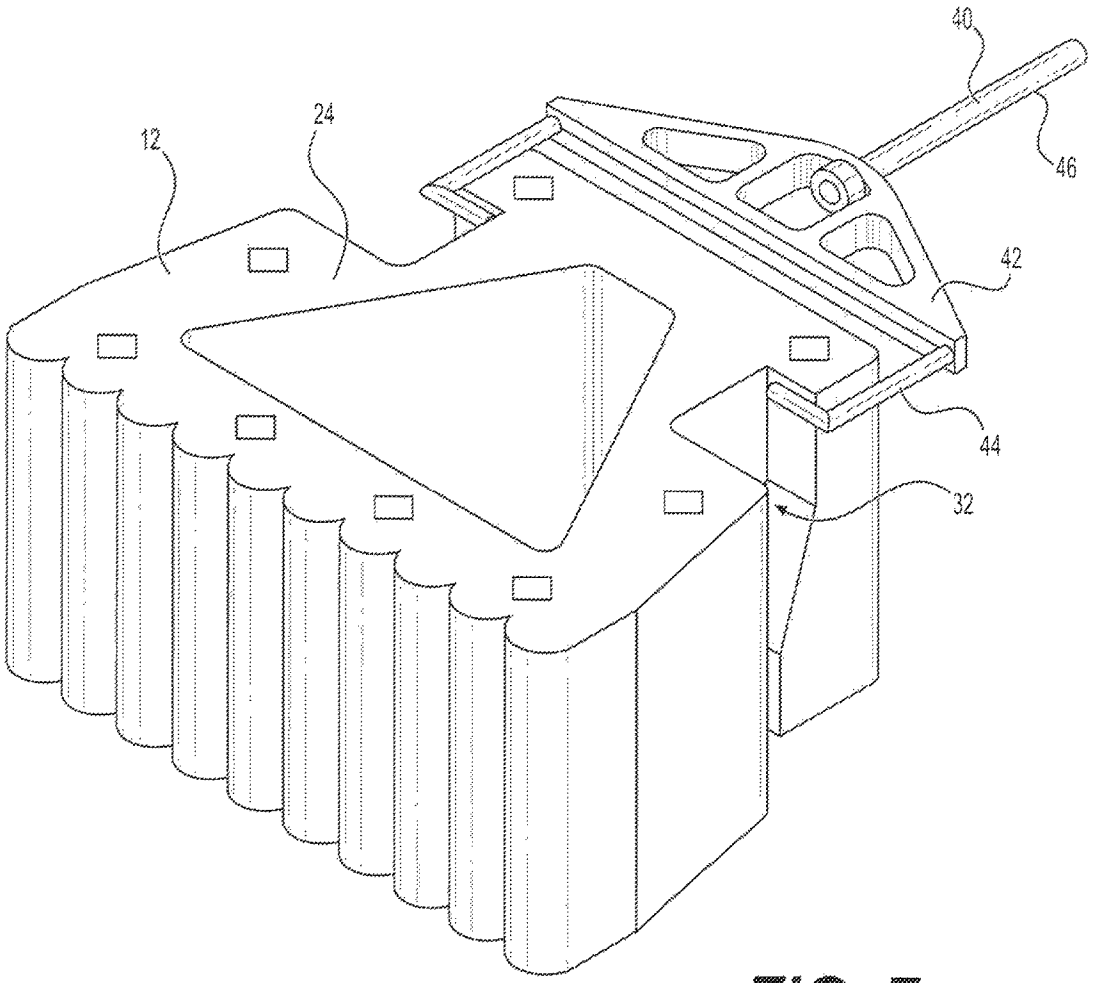
FIG. 7 is a perspective view showing connection between the tie connector of FIG. 6 and the block of FIG. 1.
Figure 9:
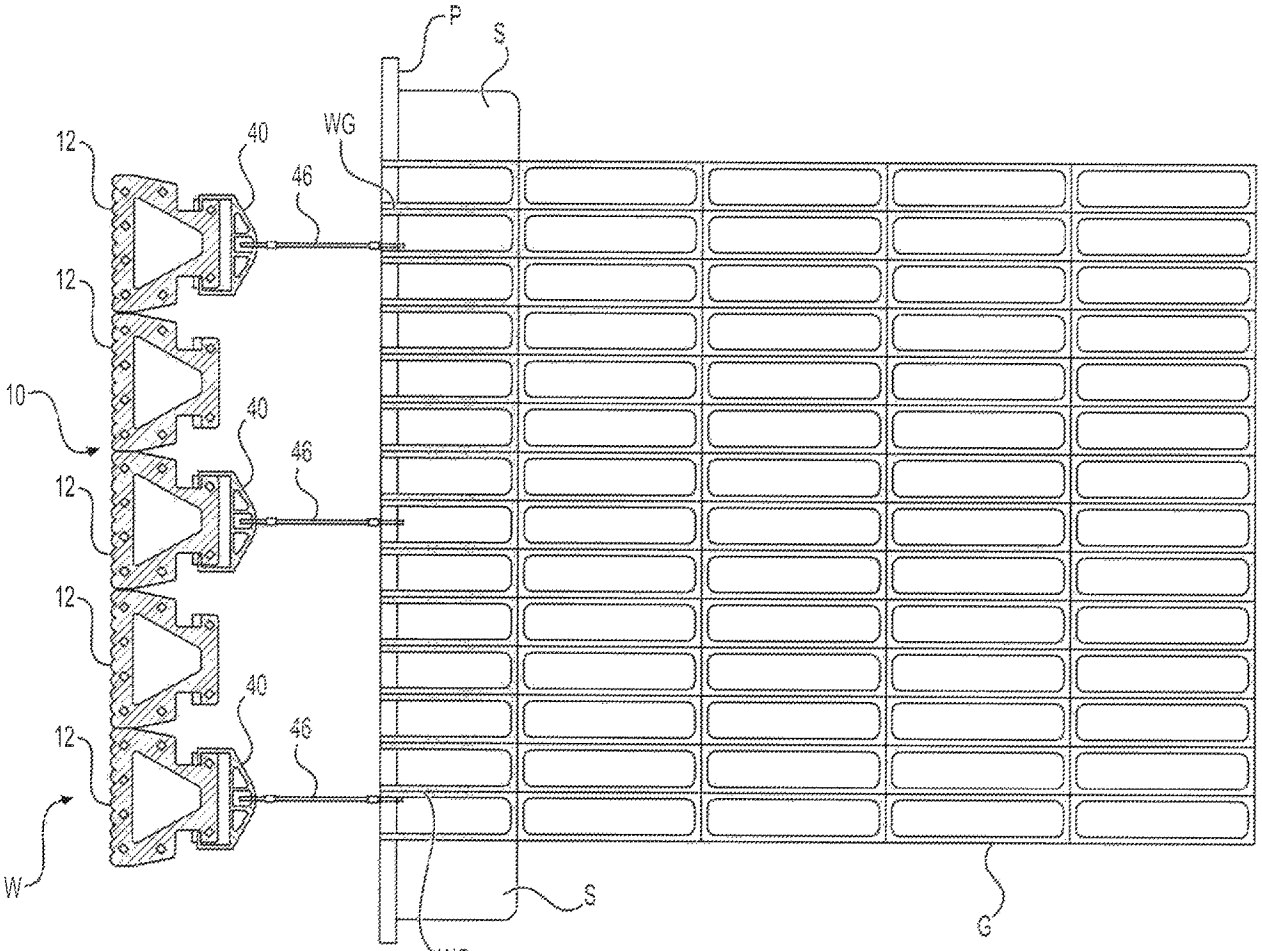
FIG. 9 is an environmental top view of the system for constructing a retaining wall.

As shown in FIGS. 6 and 9, the system 10 can include a plurality of tie connectors 40 for connecting the blocks 12 to an external pipe P. Each tie connector 40 has a main body portion 42, having laterally opposed first and second ends 52, 54, respectively, and a rod 46. The rod 46 has laterally opposed first and second ends 48, 50, respectively, with the second end 50 being secured to the first end 52 of the main body portion 42. The first end 48 of the rod 46 is adapted for securement to the external pipe P, and rod 46 extends laterally from the main body portion 52. Each tie connector 40 also includes a pair of longitudinally opposed, substantially L-shaped legs 44 secured to the second end 54 of the main body portion 42 and extending laterally therefrom.

As shown in FIGS. 7, 8A, 8B, 8C and 8D, the pair of longitudinally opposed, substantially L-shaped legs 44 are adapted to slidably engage the pair of longitudinally opposed, vertically extending recesses 32 of each block 12. In order to allow each tie connector 40 to vertically settle as earth is filled around the blocks 12 forming the retaining wall W (shown in FIG. 9), each vertically extending recess 32 may have an upper portion 56, a lower portion 60 and a central portion 58, with the central portion 58 having a lateral length less than a lateral length of the upper portion 56, and the lower portion 60 having a lateral length less than the lateral length of the central portion 58. As shown, the lateral length of the central portion 58 may be tapered, such that it decreases at a linear rate from its maximum lateral length (i.e., the constant lateral length of upper portion 56) to its minimum lateral length (i.e., the constant lateral length of lower portion 60). Corresponding to the exemplary dimensions given above, the lateral length of upper portion 56 may be 75 mm, and the lateral length of lower portion 60 may be 50 mm, with central portion 58 decreasing at a linear rate between 75 mm and 50 mm. It should be noted that, as an alternative, the tapering of the lateral length of central portion 58 may be non-linear.

Figure 8A:
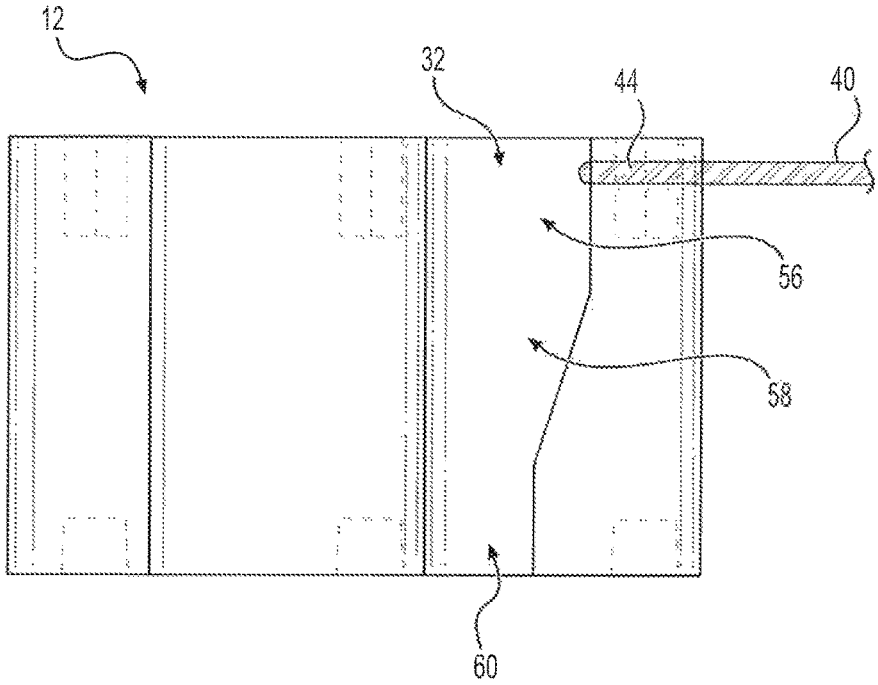
FIG. 8A is a side view of the tie connector of FIG. 6 mounted on the block of FIG. 1.
Figure 8B:
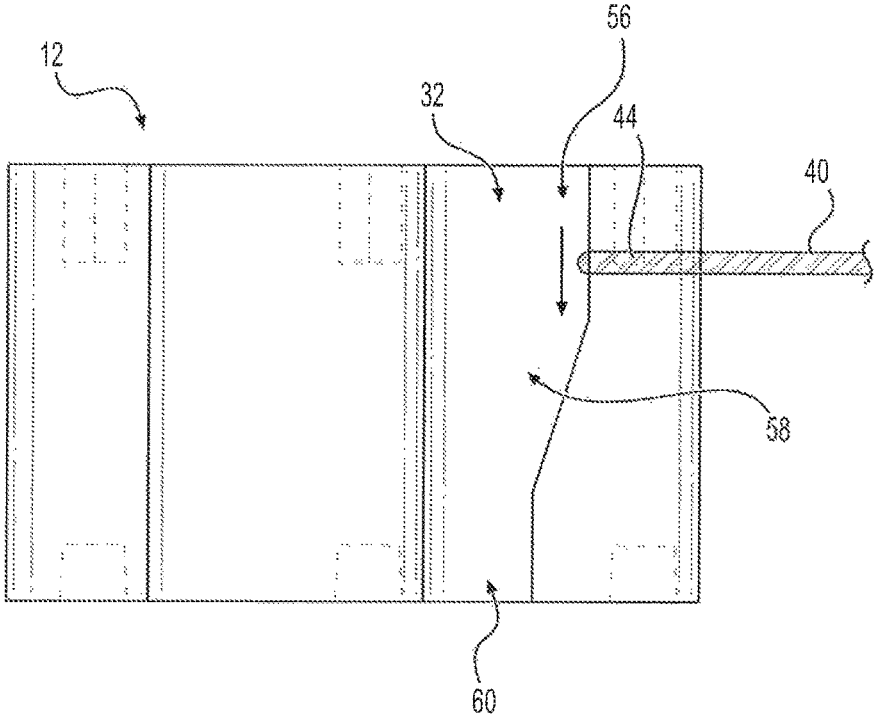
FIG. 8B is a side view of the tie connector of FIG. 6 mounted on the block of FIG. 1, following settling of the tie connector.
Figure 8C:
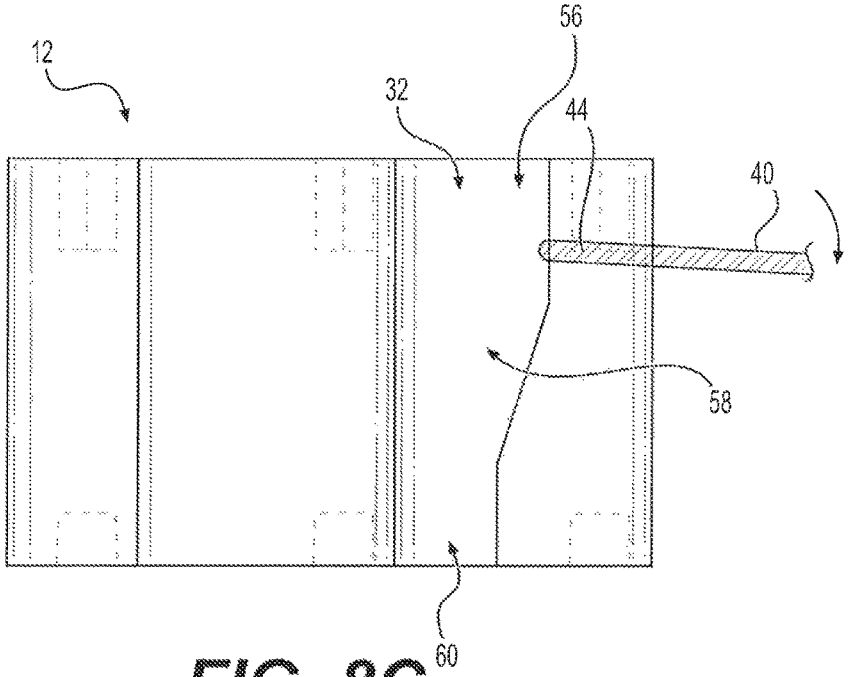
FIG. 8C is a side view of the tie connector of FIG. 6 mounted on the block of FIG. 1, showing downward rotation of the tie connector due to further settling thereof.
Figure 8D:
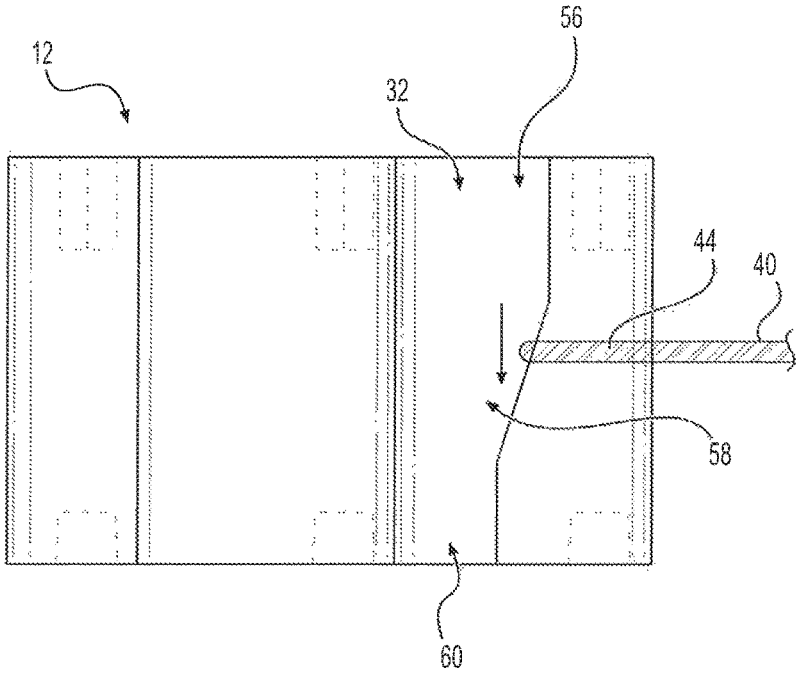
FIG. 8D is a side view of the tie connector of FIG. 6 mounted on the block of FIG. 1, with the tie connector in position following further settling thereof.

FIG. 8A shows the initial position of tie connector 40, with substantially L-shaped legs 44 received within upper portions 56 of the vertically extending recesses 32. After settling, as shown in FIG. 8B, the substantially L-shaped legs 44 fall vertically toward the decreased width central portion 58. FIG. 8C shows downward rotation of the substantially L-shaped legs 44 as the tie connector 40 further settles due to the filling of earth around blocks 12 of wall W (shown in FIG. 9). FIG. 8D shows the position of tie connector 40 after further settlement and following tightening thereof. Each tie connector 40 may be formed from high density polyethylene or any other suitable material. The differential settlement between the fill in the recess 32 and the backfill is taken care of by the rotation of the tie connector 40, as shown in FIG. 8C.

Figure 10:
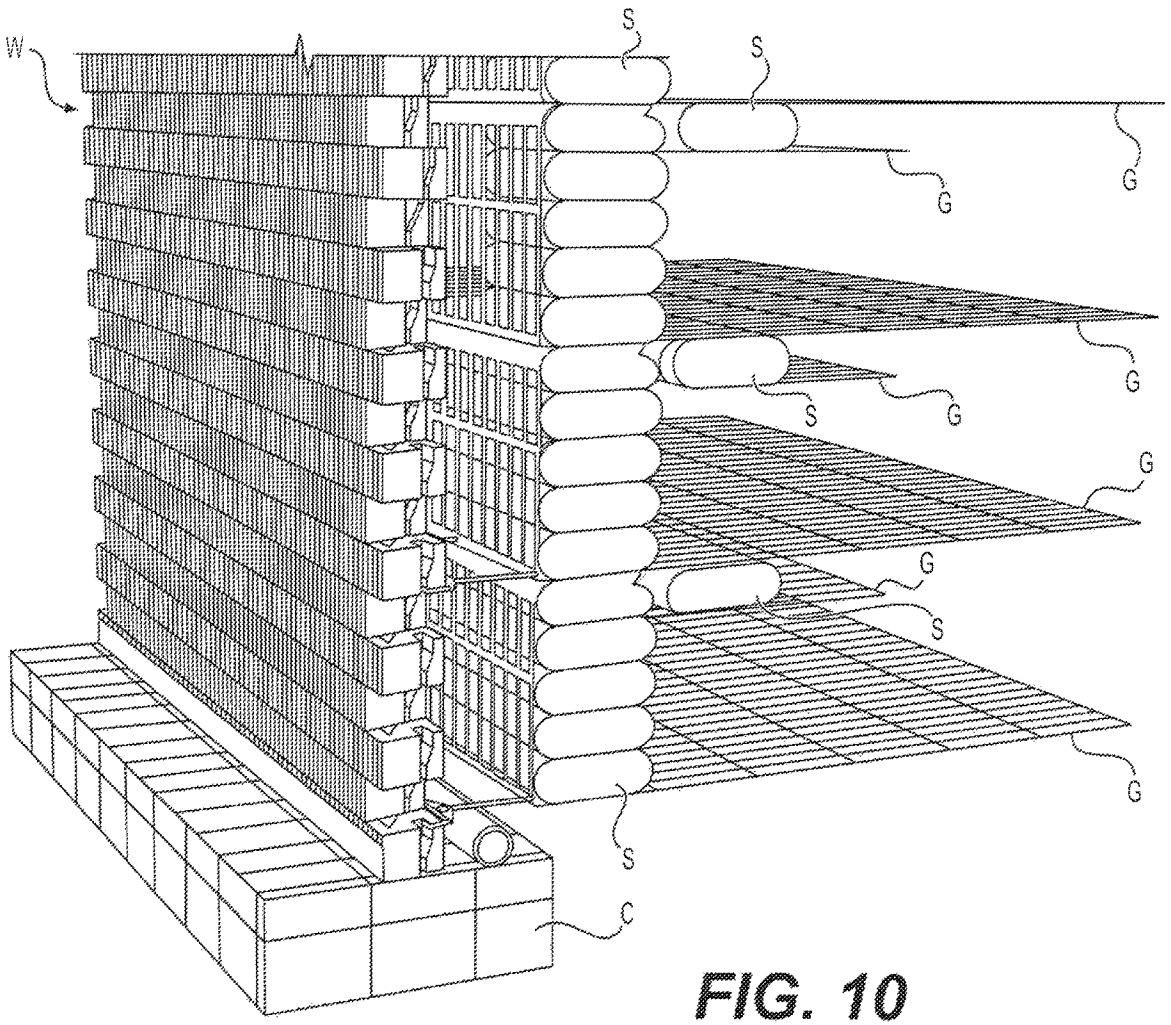
FIG. 10 is a partial environmental perspective view of the system for constructing a retaining wall, shown without earth-fill.
Figure 11:
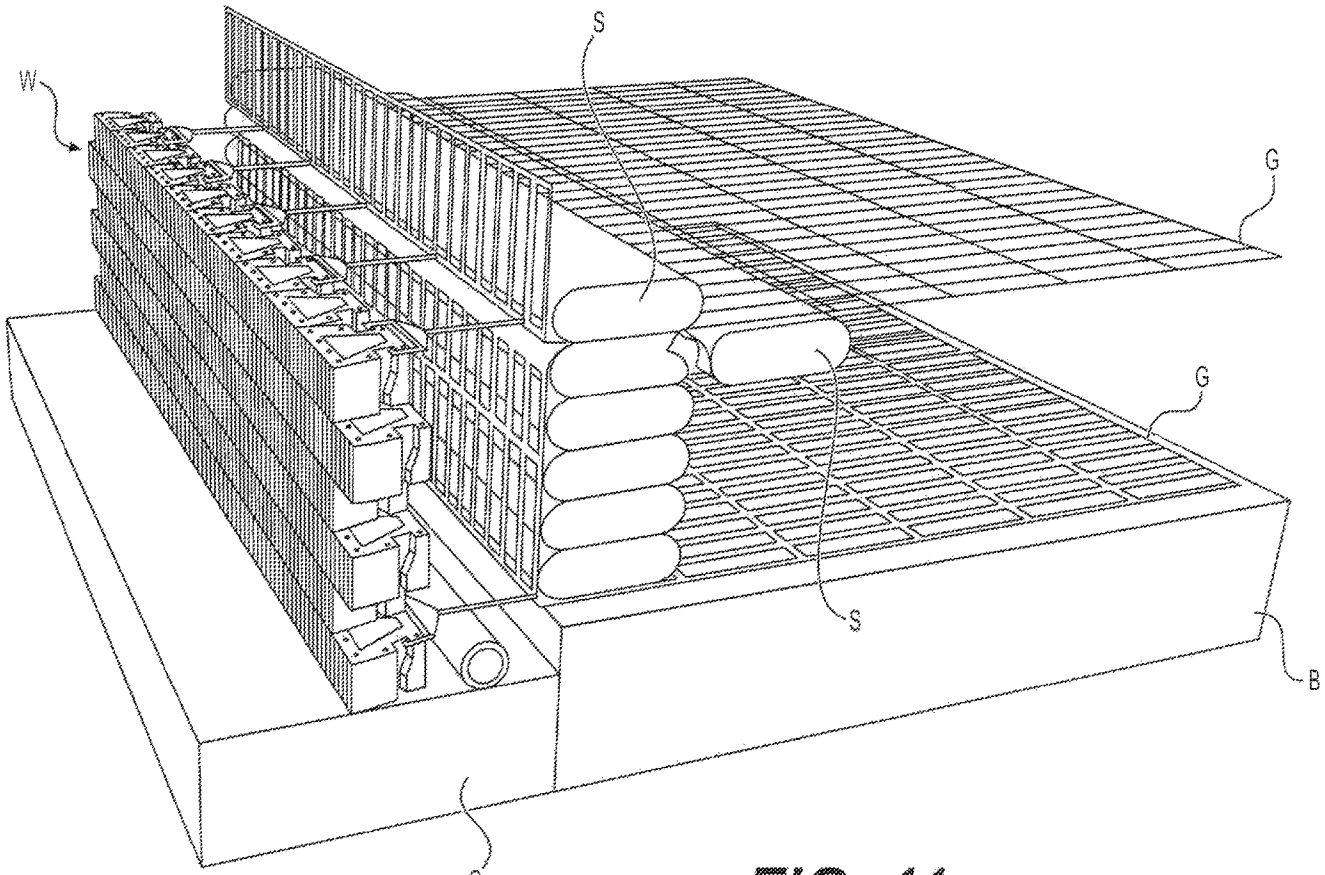
FIG. 11 is a partial environmental perspective view of the system for constructing a retaining wall, shown without earth-fill.

With reference to FIGS. 9, 10 and 11, construction of wall W with the set of interlocking blocks for constructing a retaining wall W is performed by the following method:

a) Prepare a levelled footing pad of concrete C. The width of the pad is preferably such that the projection on either side of the block is 300-400 mm. The thickness of pad may be about 300 mm;

b) place the first course of blocks 12 on the concrete pad C in proper alignment;

c) place drainage fill (such as 4 mm chip with a maximum of 5% fines) within and behind blocks 12, approximately half-way up the block and over a width of about 400 mm behind the block 12. The drainage fill is preferably self-compacting, but should still be lightly tamped with a manual tamper in and around the block 12 to ensure a dense state;

d) backfill behind drainage zone with backfill gravel B. Hand operated compaction equipment may be used within approximately 1.0 m on the back of the drainage zone;

c) spread the geogrid G on the backfill B. An extra length of geogrid G (typically approximately 1.5 m) is kept on the side of wall W. A row of sand-filled gunny bags S are then placed on the geogrid G;

f) place a pipe P under the edge of the sand-filled gunny bags S;

g) place the tie connectors 40 to connect the blocks 12 with pipe P. Tie the tie connectors 40 to the pipe P;

h) wrap the geogrid (i around the sand-filled gunny bags S and pull the tail end of geogrid (G (shown as wrapped geogrid WG in FIG. 9);

i) fill the gap between sand-filled gunny bag row and blocks 12 with gravel chips. The passages 22 of the blocks 12 are also filled at this stage;

j) turn the geogrid G towards wall 12 and backfill soil on the other side of the gunny bag row;

k) place the next row of blocks 12 with a longitudinal offset of one-quarter or half-width of the blocks 12;

l) Repeat steps i) to k) for placing 3 to 4 courses of blocks 12 (as per design) before the requirement of the next level of ties 40 for connecting blocks 12 with the pipe P;

m) press the geogrid end under an adjoining row of gunny bags S; and n) repeat steps e) to m) for completing the construction of the full height of wall W.

Typically, pipe P will be laid parallel to and under the row of sand bags S at a distance between 0.5 m to 1.0 m behind the blocks 12 forming wall W. The use of the wrap around the stack of sand-filled gunny bags S reduces the lateral earth pressure on segmental retaining wall W, thus allowing for the construction of higher walls than those constructed by conventional methods. The lesser earth pressure on the blocks 12 also minimizes the chance of failure of wall W.

The space between two adjoining blocks 12 in a single course (i.e., within a single row of the wall W) allows for gravel chip filling in this region, which provides aggregate interlock between the two consecutive courses of wall W, particularly for blocks 12 laid in offset positions with respect to one another. This space is also used for positioning of the connector ties 40, and permits the settlement of the connector ties 40 shown in FIGS. 8A-8D due to the connection between the aggregate of the backfill soil in this region.

It is to be understood that the system for constructing a retaining wall is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A system for constructing a retaining wall, comprising a plurality of blocks, wherein each said block has:

a) laterally opposed first and second end portions, b) a central portion, and c) a neck portion, the central portion being positioned between the first end portion and the neck portion, and the neck portion being positioned between the second end portion and the central portion, wherein the central portion having a longitudinal length less than a longitudinal length of the first end portion, the second end portion having a longitudinal length less than the longitudinal length of the central portion, and the neck portion having a longitudinal length less than the longitudinal length of the second end portion, a vertically extending passage being formed through the central and neck portions, d) vertically opposed upper and lower surfaces, a plurality of upper recesses being formed in the upper surface, and a plurality of lower recesses being formed in the lower surface, and e) a pair of longitudinally opposed, vertically extending recesses defined by the central portion, neck portion and second end portion thereof, wherein each of the vertically extending recesses has an upper portion, a lower portion and a central portion, the central portion having a lateral length less than a lateral length of the upper portion, and the lower portion having a lateral length less than the lateral length of the central portion;

a plurality of tie connectors, wherein each tie connector consists of:

i) a main body portion having laterally opposed first and second ends:

ii) a rod having laterally opposed first and second ends, the second end of the rod being secured to the first end of the main body portion, the rod extending laterally from the main body portion; and iii) a pair of longitudinally opposed, L-shaped legs secured to the second end of the main body portion and extending laterally therefrom, whereby the pair of longitudinally opposed, L-shaped legs are dimensioned and configured to fit about the second end of the main body portion and to slidably engage the pair of longitudinally opposed, vertically extending recesses of each block.

2. The system for constructing a retaining wall as recited in claim 1, further comprising a plurality of pegs, wherein each said peg has opposed first and second ends, the first end thereof being adapted to be received within one of the plurality of upper recesses of one of the plurality of blocks, the second end thereof being adapted to be received within one of the plurality of lower recesses of an adjacent one of the plurality of blocks.

3. The system for constructing a retaining wall as recited in claim 2, wherein each said upper recess of each said block has a substantially square cross-sectional contour, and the first end of each said peg has a mating substantially square cross-sectional contour.

4. The system for constructing a retaining wall as recited in claim 3, wherein each said lower recess of each said block has a substantially circular cross-sectional contour, and the second end of each said peg has a mating substantially circular cross-sectional contour.

* * * * *